US007958571B2

(12) United States Patent
Kitsch et al.

(10) Patent No.: US 7,958,571 B2
(45) Date of Patent: Jun. 14, 2011

(54) UNDERWEAR GARMENT FOR A MALE

(75) Inventors: William Trent Kitsch, Kelowna (CA); Craig Golinowski, Calgary (CA)

(73) Assignee: Saxx Apparel, Ltd., Kelowna, BC (CA)

( * ) Notice: Subject to any disclaimer, the term of this patent is extended or adjusted under 35 U.S.C. 154(b) by 778 days.

(21) Appl. No.: 12/000,966

(22) Filed: Dec. 19, 2007

(65) Prior Publication Data

US 2008/0178369 A1 Jul. 31, 2008

Related U.S. Application Data

(60) Provisional application No. 60/886,545, filed on Jan. 25, 2007.

(51) Int. Cl.
*A41B 9/02* (2006.01)

(52) U.S. Cl. ..... 2/403; 2/405

(58) Field of Classification Search ..... 2/400–405; 602/67, 68; 450/104
See application file for complete search history.

(56) References Cited

U.S. PATENT DOCUMENTS

| | | | | | |
|---|---|---|---|---|---|
| 2,033,551 | A | | 3/1936 | Rumery | |
| 2,254,863 | A | | 9/1941 | Weihe | |
| 2,328,953 | A | * | 9/1943 | Chatfield et al. | 602/67 |
| 2,438,310 | A | * | 3/1948 | Ashe et al. | 2/403 |
| 2,601,602 | A | | 6/1952 | Firshing, Sr. | |
| 2,623,210 | A | * | 12/1952 | Chatfield | 450/104 |
| 2,624,336 | A | | 1/1953 | Hansley | |
| 2,641,257 | A | * | 6/1953 | Rutledge | 602/67 |
| 2,652,053 | A | | 9/1953 | Dann | |
| 2,872,685 | A | | 2/1959 | Denbo | |
| 3,207,155 | A | | 9/1965 | Casey | |
| 3,220,410 | A | | 11/1965 | Sloan | |
| 3,283,545 | A | | 11/1966 | Simon | |
| 3,294,086 | A | * | 12/1966 | Nelkin | 602/19 |
| 3,459,181 | A | * | 8/1969 | Mann | 602/67 |
| 3,496,576 | A | * | 2/1970 | Artzt | 2/402 |
| 3,499,442 | A | * | 3/1970 | Steinmetz | 602/67 |
| 3,499,443 | A | | 3/1970 | Scheerer | |
| 3,511,234 | A | | 5/1970 | Larson | |
| 3,517,666 | A | * | 6/1970 | Atlee | 602/68 |
| 3,621,846 | A | | 11/1971 | Lehman | |
| 4,009,495 | A | | 3/1977 | Faust | |
| 4,173,976 | A | | 11/1979 | Bloomquist et al. | |
| 4,195,630 | A | | 4/1980 | Connery et al. | |

(Continued)

*Primary Examiner* — Katherine Moran
*Assistant Examiner* — Richale L Quinn
(74) *Attorney, Agent, or Firm* — Blakely, Sokoloff, Taylor & Zafman, LLP

(57) ABSTRACT

An underwear garment for use by a male, that is, a person having a penis and a scrotum, may be characterized as including a genital pouch and a pair of side panels collectively formed in a mid-section of a front wall depending from a waistband so as to bisect said front wall. The pouch may be pear-shaped when viewed from the front. A lower extremity of the pouch extends under and rearwardly of the front wall so as to form a perineum portion for covering rearwardly past the scrotum and to the perineum of the user. The pouch also has a phallus supporting portion extending forwardly of a plane generally containing the front wall and forming therein an apex portion for containing the head of the penis of the user when the penis is hanging at rest. The pouch also has a scrotum supporting portion extending from and between the phallus supporting portion and the perineum portion for containing at least a portion of the scrotum of the user.

11 Claims, 13 Drawing Sheets

U.S. PATENT DOCUMENTS 4,377,008 A 3/1983 Jung
4,414,971 A 11/1983 Chung
4,554,685 A * 11/1985 Ray ..... 2/403
4,660,551 A 4/1987 Nishimura
4,702,239 A 10/1987 Ichikawa
4,759,355 A 7/1988 Thrower
4,870,958 A 10/1989 Webster
4,955,088 A 9/1990 Terjesen
5,029,345 A * 7/1991 Angheluta et al. ..... 2/403
5,070,869 A 12/1991 Zhang
5,157,793 A 10/1992 Michels
5,226,179 A 7/1993 Choi
5,237,706 A 8/1993 Nalbandian
5,283,912 A 2/1994 Chung
5,379,462 A * 1/1995 Morgan et al. ..... 2/403
5,461,729 A 10/1995 Brocks
5,524,298 A 6/1996 Plunkett
5,547,466 A 8/1996 McRoberts et al.
5,598,587 A 2/1997 Wada
5,647,065 A 7/1997 Richerson
5,718,003 A 2/1998 Gwinn
5,807,299 A 9/1998 McRoberts et al.
5,870,779 A 2/1999 Heron
5,875,495 A * 3/1999 Thrower ..... 2/403
5,978,971 A 11/1999 Wald
6,026,517 A 2/2000 Kang
6,038,703 A 3/2000 Chung
6,061,840 A 5/2000 Alligator
6,245,036 B1 6/2001 McRoberts et al.
6,289,520 B1 * 9/2001 Page ..... 2/403
6,295,651 B1 10/2001 Kang
6,308,342 B1 10/2001 Qi
6,353,940 B1 3/2002 Lyden
6,487,728 B1 12/2002 Cook
6,799,334 B2 10/2004 Yu
6,820,284 B2 11/2004 Horikoshi et al.
6,862,746 B2 3/2005 Cym et al.
6,901,607 B1 6/2005 Elwell
D509,945 S 9/2005 Ogle
7,017,193 B2 3/2006 Auger
7,024,703 B1 4/2006 Della Ratta
7,065,797 B1 6/2006 Chen
7,178,174 B2 * 2/2007 Soderstrom ..... 2/403
7,198,688 B2 * 4/2007 Mortell et al. ..... 156/160
7,631,369 B2 * 12/2009 Geiwald et al. ..... 2/403
7,676,853 B1 * 3/2010 Cutlip ..... 2/403
2005/0268380 A1 12/2005 Sovell
2006/0000008 A1 1/2006 Chong
2006/0005301 A1 1/2006 Taylor
2006/0162052 A1 * 7/2006 Stankowski et al. ..... 2/403
2007/0180600 A1 8/2007 Allemann et al.
2007/0192941 A1 * 8/2007 Soderstrom ..... 2/403
2007/0245463 A1 * 10/2007 Kang ..... 2/403
2008/0178368 A1 * 7/2008 Clark ..... 2/403

* cited by examiner

UNDERWEAR GARMENT FOR A MALE

CROSS REFERENCE TO RELATED APPLICATION

This application claims priority from U.S. Provisional Patent Application No. 60/886,545 filed Jan. 25, 2007 entitled Underwear Garment for a Male.

FIELD OF THE INVENTION

This invention relates to the field of men's undergarments generally, and in particular to an undergarment having an improved pouch and sidewalls for supporting genitalia and decreasing irritation due to skin-to-skin friction and chaffing.

BACKGROUND OF THE INVENTION

Men's underwear typically suffers from several deficiencies, including but not limited to, a propensity for the scrotum to contact and stick to the inner thigh and a high degree of contact between the inner thighs of the wearer which can lead to friction, chaffing, and discomfort while sitting, walking, running, or skating or other numerous athletic activities, a lack of support for the genitalia, limited freedom of movement and natural resting position for the genitalia and a lack of moisture control.

Various underwear designs in the prior art have tried to address one or more of these problems. For example, sports boxer-briefs are typically tight and form-fitting resulting in compressing the genitalia. However, they support the scrotum too close to the body leading to any combination of scrotum contact with inner thighs and legs, and moisture problems resulting from perspiration and skin irritation. Typical loose fitting boxer shorts provide ample freedom of movement but suffer from a propensity for the scrotum to contact and stick to the inner thigh, and lack of support and comfort. Further, the prior art typically does not use performance fabrics as those fabrics are better described below. Typical underwear briefs prevent the scrotum from contacting with the legs, but suffer from unnaturally restricting the genitalia into a small compartment pressing with an unnaturally close proximity to the body with the resultant increase in moisture problems and lack of comfort. To date, no underwear product has successfully addressed the problem of a lack of isolation of scrotum from contacting inner thighs and legs while increasing comfort and support attributes for male genitalia.

In the prior art applicant is aware of U.S. Pat. No. 5,029,345 which issued to Angheluta, et al, on Jul. 9, 1991, entitled Man's Underwear with an Integral Codpiece-like Construction. Angheluta discloses a man's garment, particularly a man's underwear garment, providing a codpiece compartment secured to a front of a trunk panel of the garment. The trunk panel provides an opening for communicating a man's genitals therethrough into the codpiece compartment. The compartment loosely holds the man's genitals. The trunk panel and a slot 24 provides for forward biasing and separation of the genitals by constricting of the sides of the slot behind the testicles and heat insulation to reduce the thermal influence of the man's torso on the man's reproductive organs. Angheluta describes the use of compartment 40 which is a loose fitting compartment around the genitals, it being taught that such a loose fitting compartment prevents compression of the genitals against the male's lower trunk, such as occurs in shorts known to the art, and that by properly selecting the lengths of the front, right and left side panels 32, 38, and 36 a suitably loose compartment 40 is formed. Angheluta concludes that by reducing compression of the genitals against the trunk, the thermal influence of the trunk to the genitals is reduced, and pressure on the genitals is reduced.

SUMMARY OF THE INVENTION

The present invention provides a solution to the above by addressing the issues of scrotum independence from inner legs, and improved comfort and support. The underwear garment is designed using a specifically shaped breathable pouch which includes elasticized breathable wicking mesh material side panels to isolate the scrotum and phallus from the legs and which wick away moisture and provides superior comfort. Thus the undergarment of the present invention includes an internal double side-panel containment system and an anatomical pouch compartment, and the use of light internal fabric and moisture control athletic performance fabrics.

In summary, the underwear garment according to the present invention, and for use by a male, that is, a person having a penis and a scrotum, may be characterized as including a genital pouch and a pair of side panels collectively formed in amid-section of a front wall depending from a waistband so as to bisect said front wall. The pouch may be pear-shaped when viewed from the front. A lower extremity of the pouch extends under and rearwardly of the front wall so as to form a perineum portion for covering rearwardly past the scrotum and to the perineum of the user. The pouch also has a phallus supporting portion extending forwardly of a plane generally containing the front wall and forming therein an apex portion for containing the head of the penis of the user when the penis is hanging at rest. The pouch also has a scrotum supporting portion extending from and between the phallus supporting portion and the perineum portion for containing at least a portion of the scrotum of the user.

The side panels are a pair of laterally spaced apart, substantially parallel side panels forming upwardly from adjacent the perineum generally vertical extending scrotum fences towards the waistband. The side panels are spaced so as to snugly engage sides of the scrotum and to substantially completely cover over and support the sides of the scrotum and to extend upwardly into a fold along a lowermost aspect of the abdomen of the user formed between the scrotum and the inner thighs of the user so as to substantially entirely cover exposed thigh skin in the fold exposed for rubbing against scrotum skin in the fold.

Advantageously the side panels are formed as opposed facing concavities so as to cup the scrotum and the side panels and pouch are formed of elasticized breathable wicking mesh. The side panels may be scimitar-shaped when viewed from the side so as to form, along with the pouch, the scrotum supporting portion as a crescent half-moon-shaped basket.

Further advantageously, the pouch has an inner lining which is smooth and seamless over a central penis-covering portion thereof, and the concavities of the side panels are formed at least in part by folding laterally inwardly and stitching uppermost ends of the side panels so as to fold over an uppermost edge of the side panels. In one embodiment this is done where the side panels extend up to the waistband, and where the pouch also extends between the side panels substantially up to the waistband.

DETAILED DESCRIPTION OF EMBODIMENTS OF THE INVENTION

Figure 7:
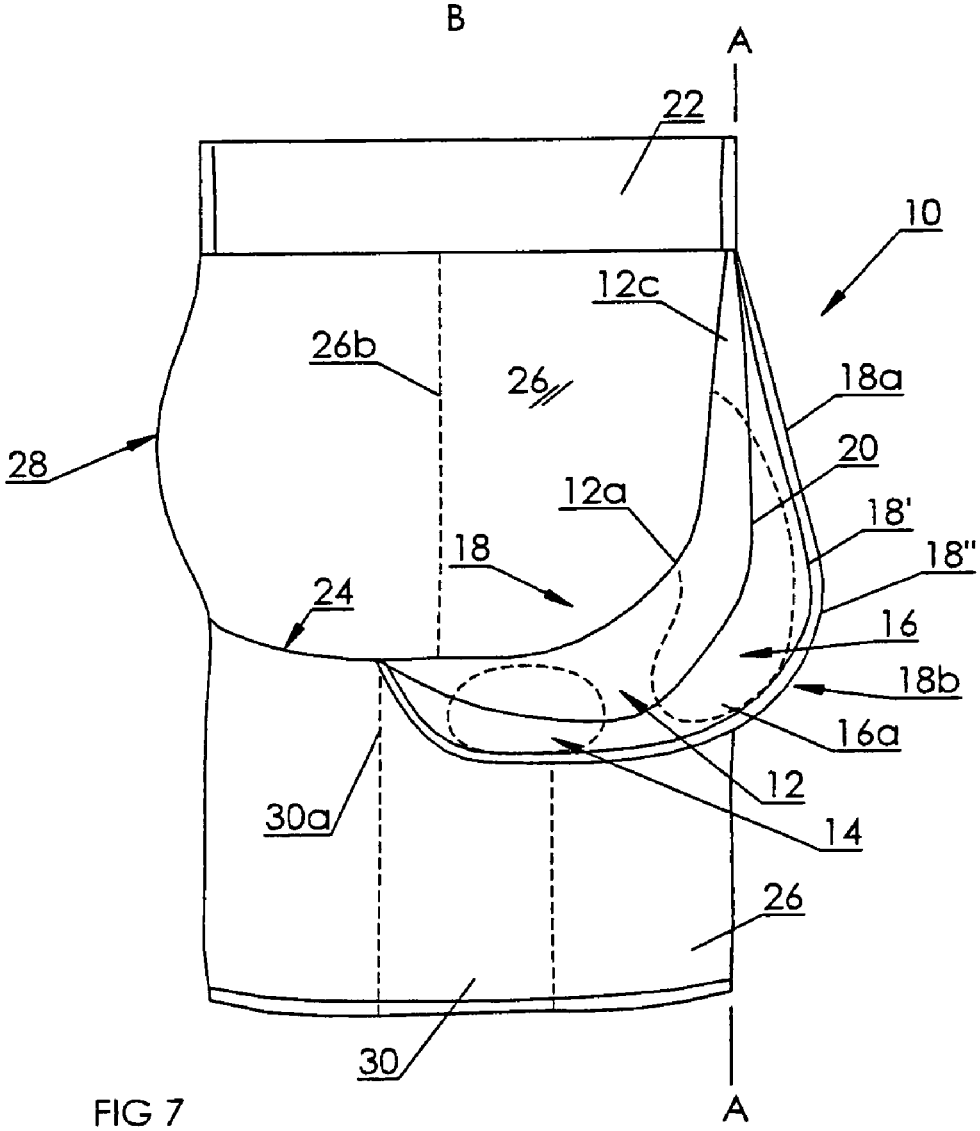
FIG. 7 is a sectional view along line 7-7 in FIG. 6.
Figure 8:
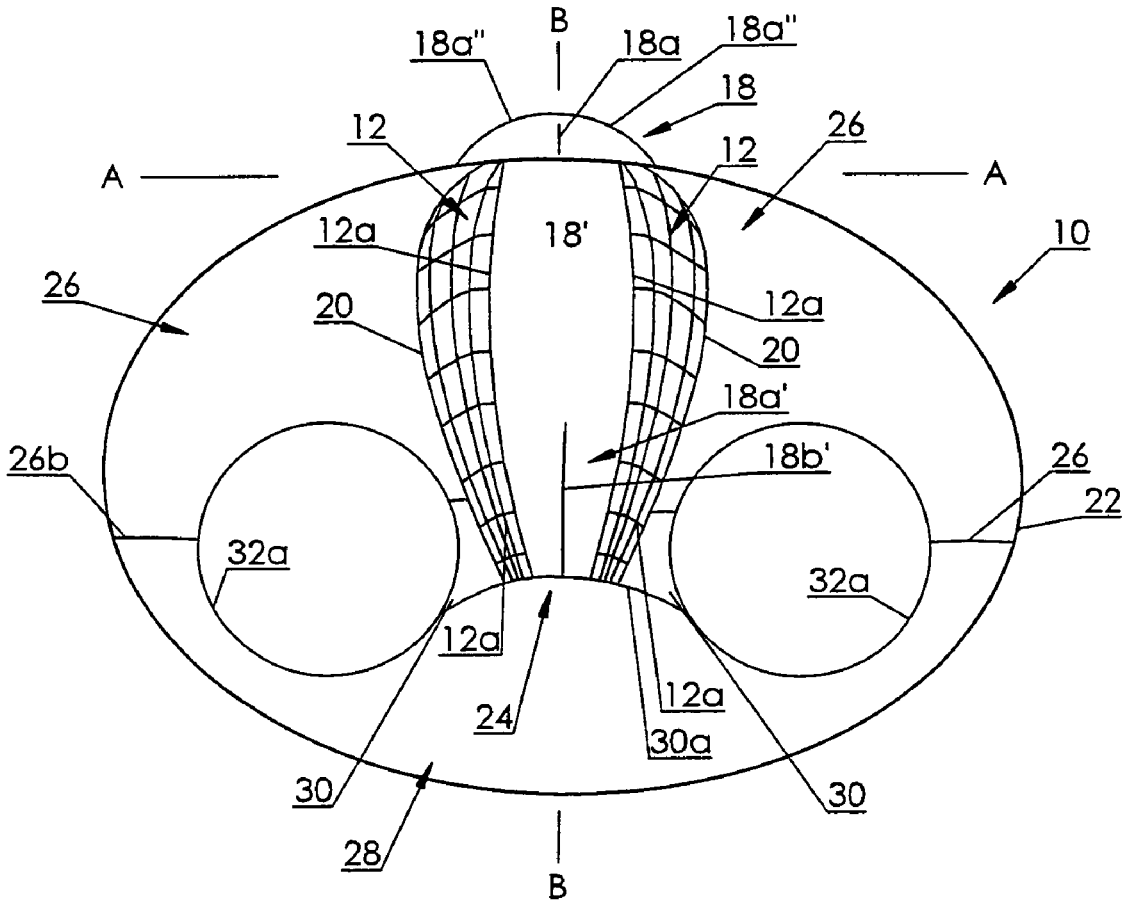
FIG. 8 is, in plan view, the brief of FIG. 2.

With reference to the accompanying drawings wherein similar characters of reference denote corresponding parts in each view, a conventional pair of so-called boxer style briefs 10 are modified in the present invention by adding interior side-panels 12, preferably constructed of an elasticized breathable mesh fabric, for the purpose of isolating the genitalia, in particular scrotum 14 and phallus 16 (shown diagrammatically in dotted outline in FIG. 7), into the pouch compartment 18, thereby isolating the genitalia from contacting the inner thighs and legs of the user 8 wearing the briefs.

As seen in the interior of briefs 10, side panels 12 are formed of two separate and substantially parallel pieces of mesh fabric attached to the laterally spaced apart pouch seams 20.

The side panels 12 form a pair of generally parallel fences which extend upwardly from, and along, seams 20 so as to extend their uppermost edges 12*a* upwardly substantially completely into the crack or fold between the laterally outer sides of scrotum 14 and the top of the inner thighs, that is, along the fold of skin where the top of the inner thighs join the top of the scrotum along a lower-most aspect of the abdomen of user 8. This joint, where the inner thighs and scrotum join along a fold line, is defined generally by both the shape and the location when worn of the upper-most arcuate edges 12*a* of side panels 12. The side panels are preferably thin sheets of elasticized breathable wicking mesh knit, one sheet per panel and form a substantially parallel pair of opposed wicking fences which are positioned unobstructively substantially completely up into the fold line between the scrotum and inner thigh to thereby inhibit chaffing and to draw moisture away from where there would ordinarily be skin-to-skin contact and rubbing. Side panels 12 provide for an enlarged moisture evaporation surface area on the wicking material as relative movement between the thighs and scrotum, for example due to athletic activity, draws cooler air upwardly into the brief or otherwise through the brief material so as to flow over the wicking material, evaporating moisture wicked from the fold and thereby providing cooling or the sensation of cooling. The two side panels 12 thus separate the scrotum 14 from contacting the inner thighs and legs of the user, such separation extending from the waistband 22 to the perineum area 24 which extends under the buttocks of user.

Figure 1:
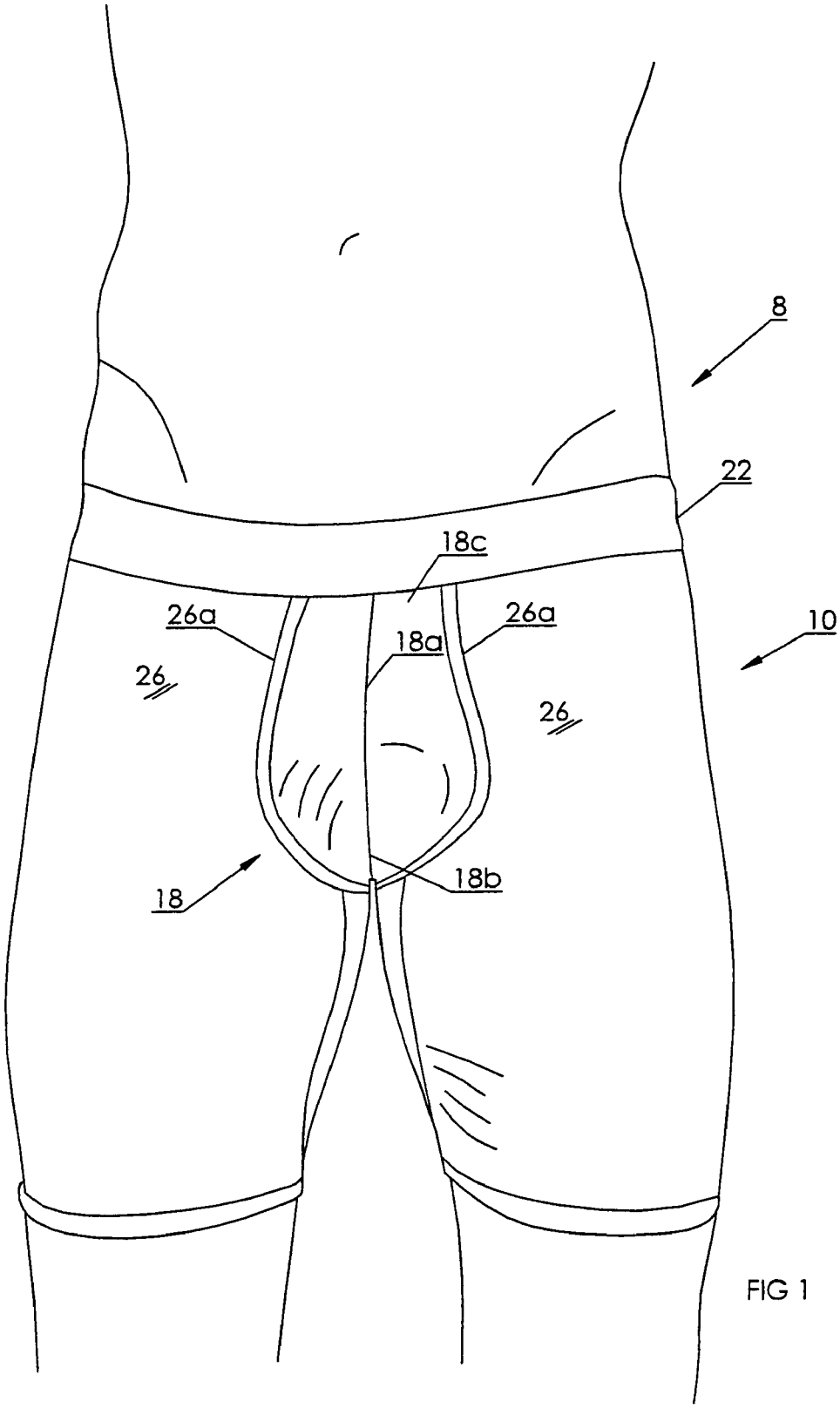
FIG. 1 is, in front elevation view, a pair of the briefs according to one embodiment of the present invention being worn by a male user.
Figure 2:
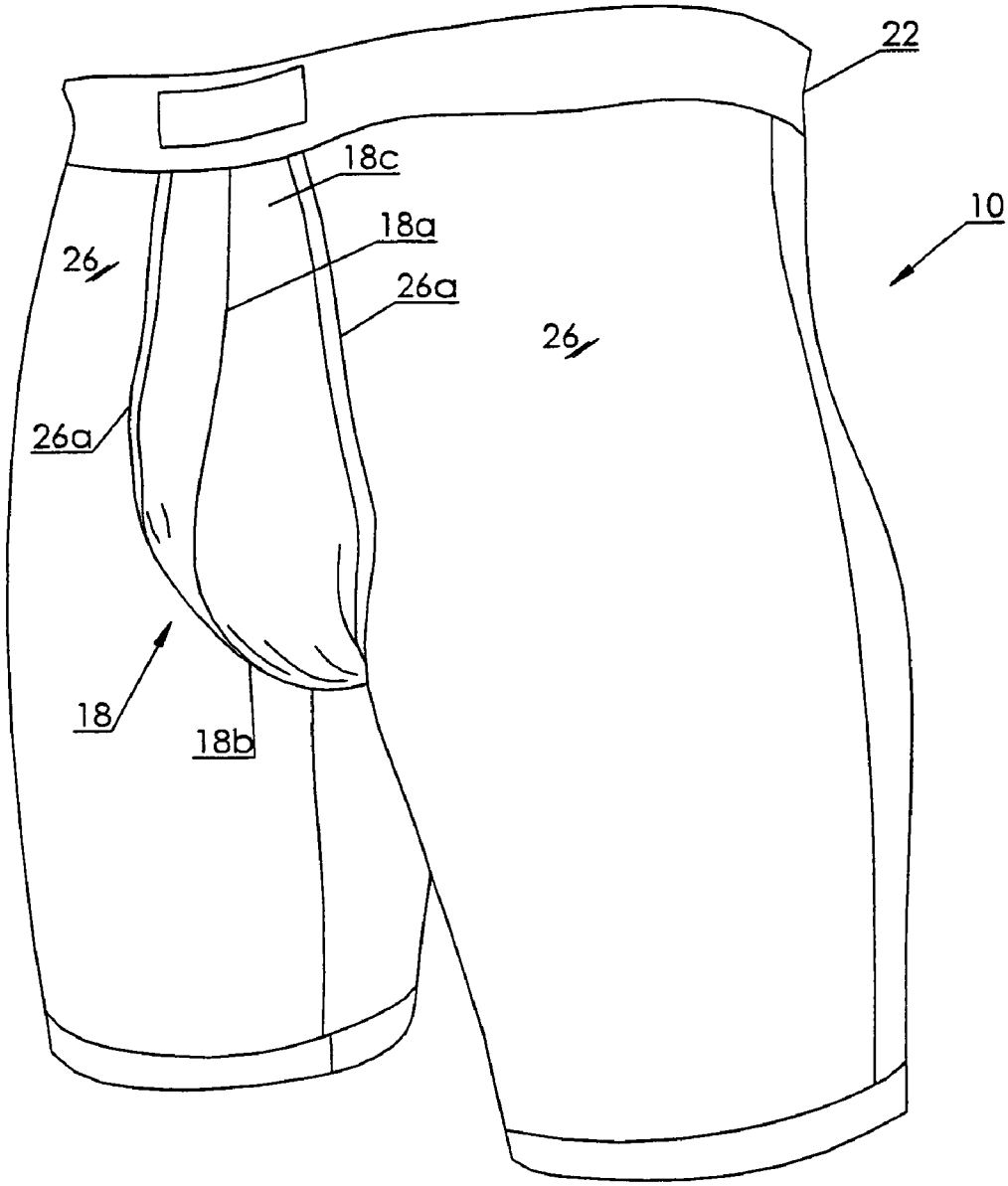
FIG. 2 is, in right side perspective view, the briefs of FIG. 1.
Figure 3:
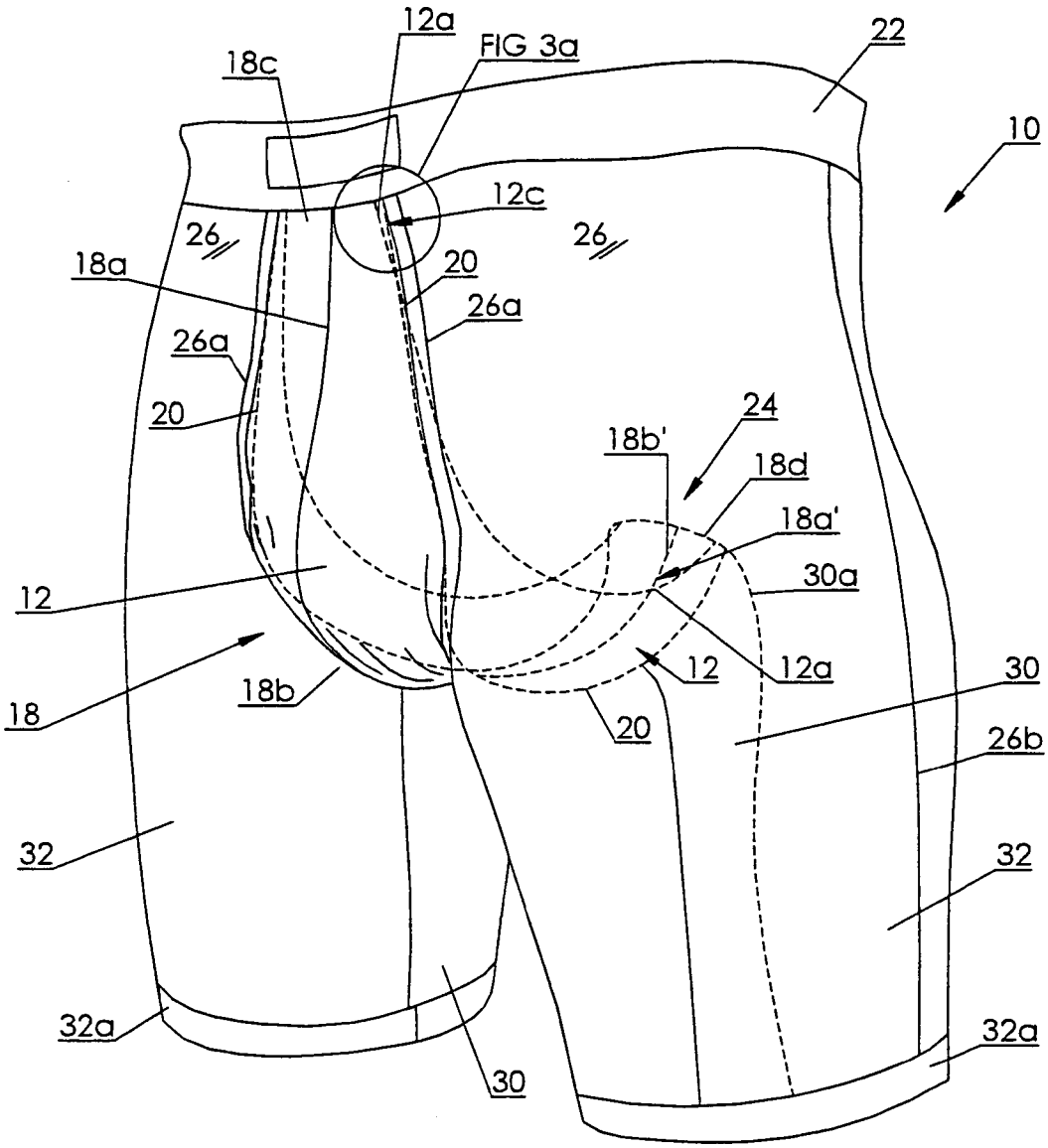
FIG. 3 is, the briefs of FIG. 2, showing the side panels of the genitalia containing pouch in dotted outline.
Figure 3A:
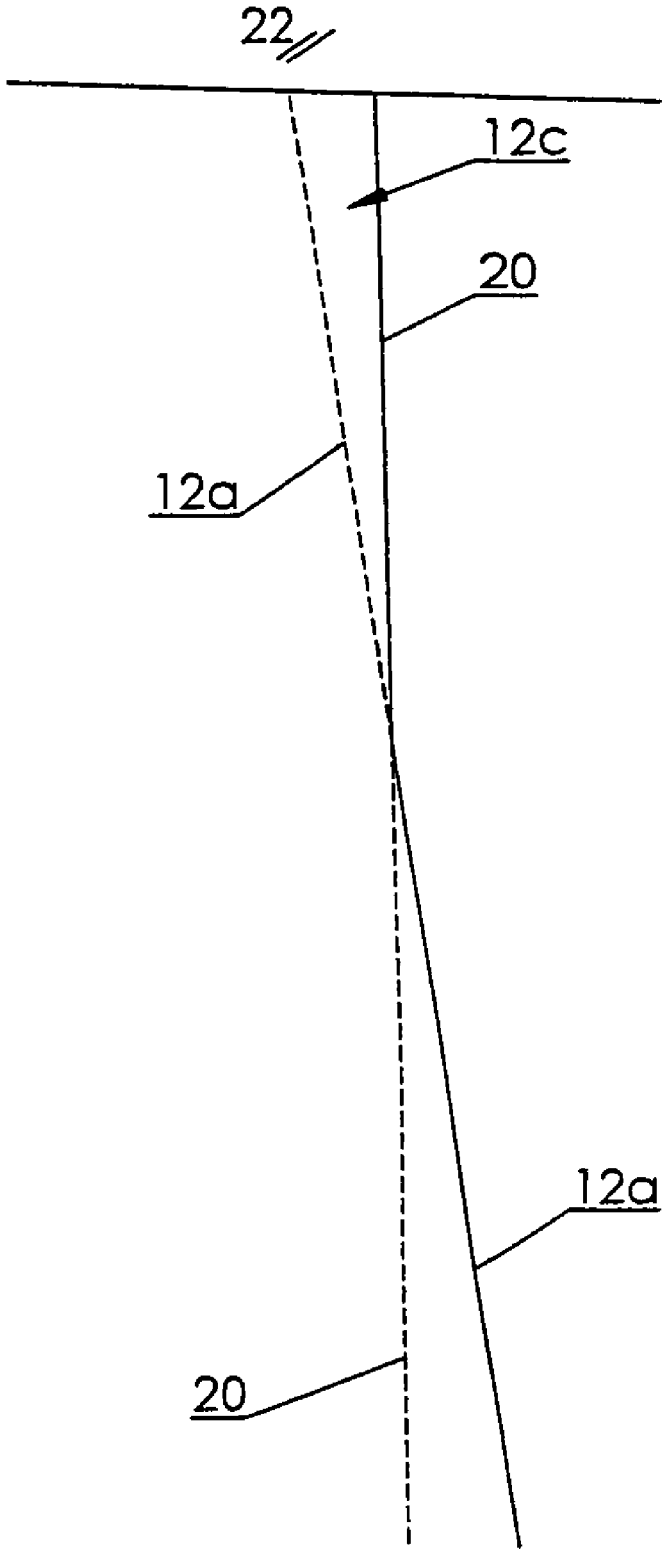
FIG. 3*a* is an enlarged view of a segment of FIG. 3 showing the inwardly folded overlap of the upper edge of one of the side panels of FIG. 3.
Figure 5:
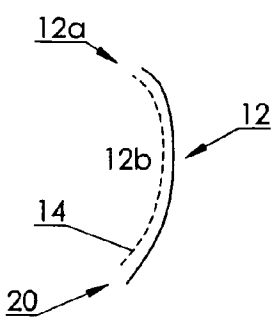
FIG. 5 is a cross-sectional view along line 5-5 in FIG. 4.
Figure 4:
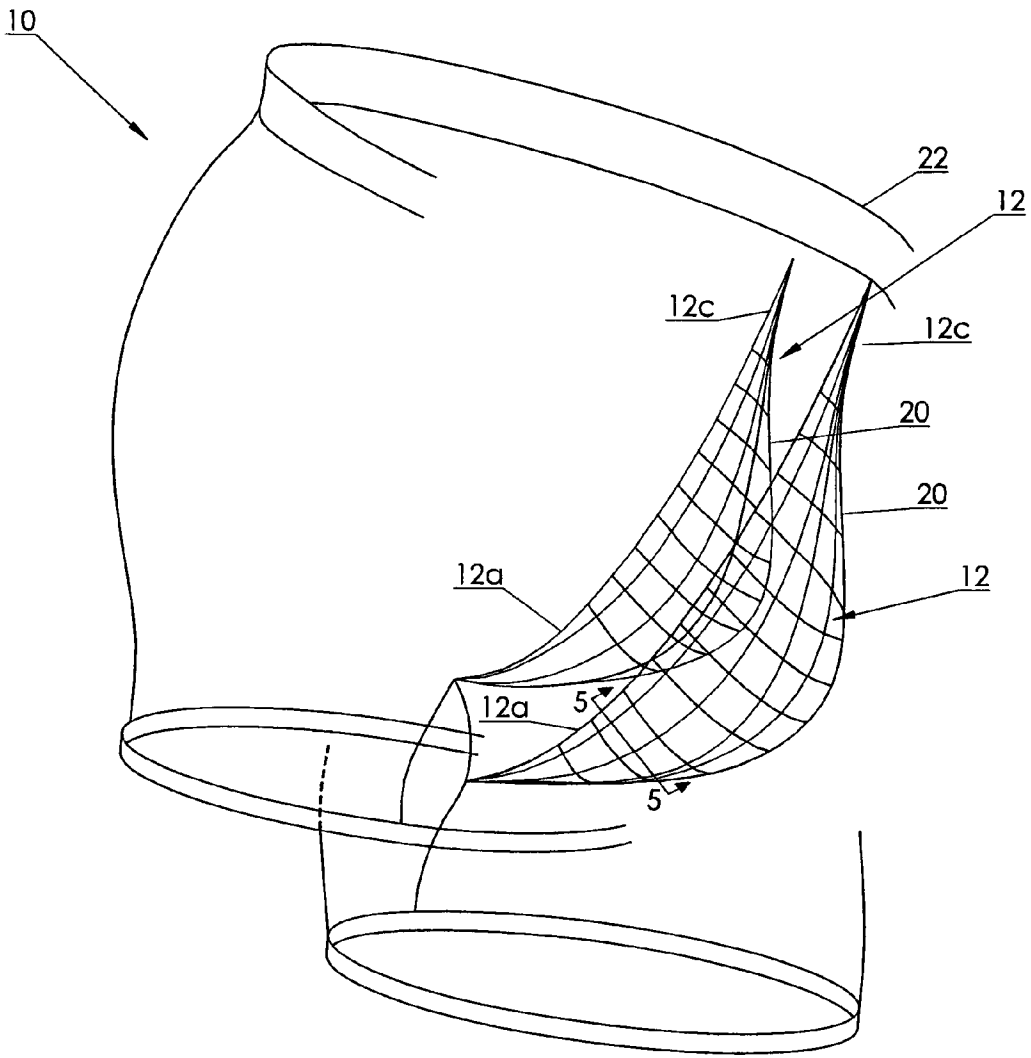
FIG. 4 is, in partially cut-away left perspective view, the briefs of FIG. 3 showing a diagrammatic illustration of the side panels.
Figure 6:
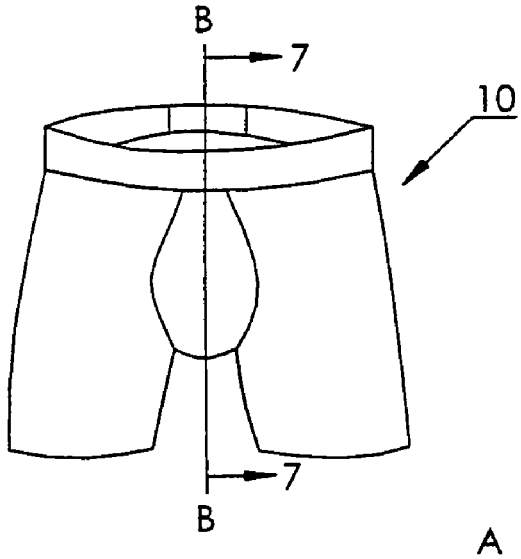
FIG. 6 is a front view of the briefs of FIG. 2 illustrating a vertical axis of symmetry and bisecting the briefs.

The pair of side panels 12 are preferably formed so as to cup the genitalia, that is, are formed so as to be cupped in laterally opposed facing relation to inhibit skin-to-skin contact between a user's thighs and scrotum. Although positioned to extend generally orthogonally inwardly from the front of the brief, for example where the front of the brief is defined by plane A which generally contains the pair of pouch seams 20, the laterally outward curvature of the side panels may be described as convex, for example as seen in the cross-section of FIG. 5. Those oppositely disposed convexities of course define an opposed facing pair of genitalia-supporting concavities 12*b* which, because of the flexibility and elasticity of the mesh side panel material, mould to gently conform to the shape of scrotum 14 in particular and allow for resiliently supported relative movement of the scrotum relative to the pubis and perineum 24 of user 8, side panels 12 resiliently cradling and biasing the scrotum back into its naturally resting position symmetrically depending below the pubis and base of the penis 16. As better seen in FIG. 3, in one embodiment the concavities 12*b* of side panels 12 are formed by folding over inwardly, and stitching with the fold-over in place, the upper ends 12*c* of side panels 12 where side panels 12 are stitched to the front walls 26 and waistband 22 of brief 10.

Figure 9:
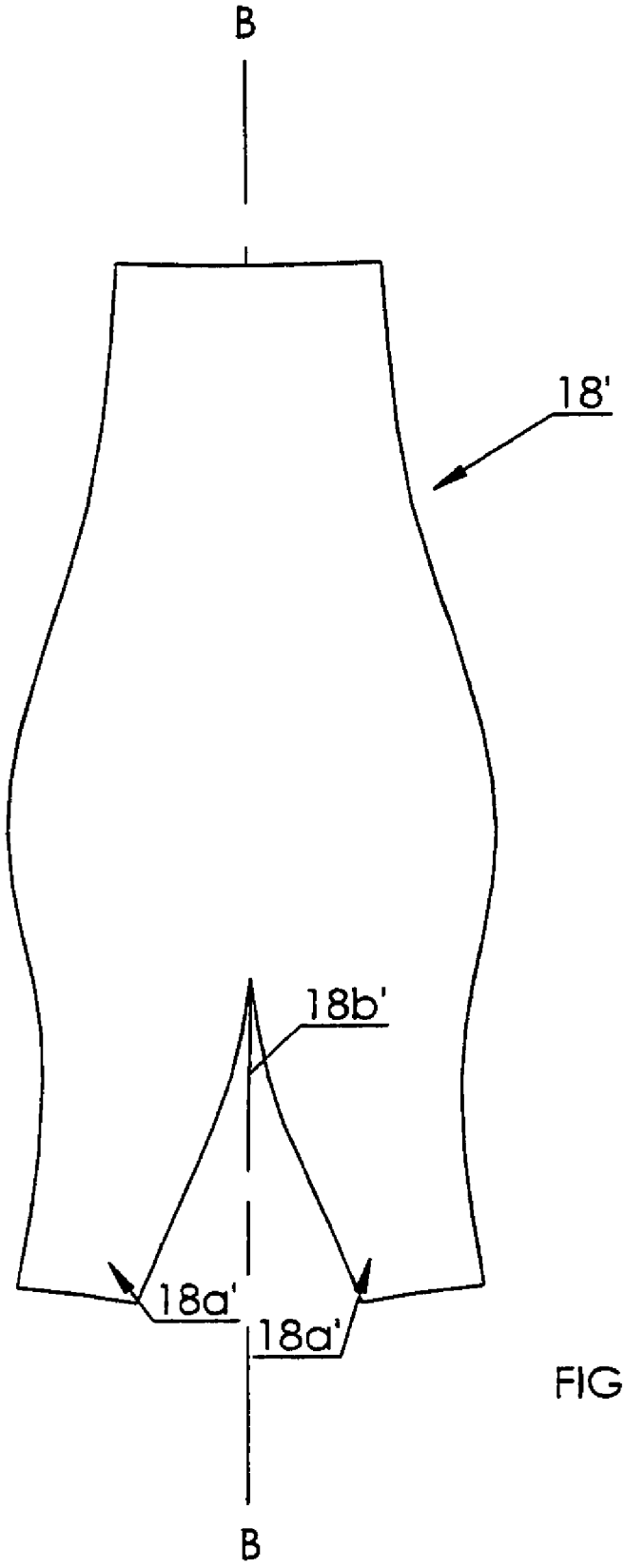
FIG. 9 is a diagrammatic plan view of a pattern template for the inner liner of the pouch of the briefs of FIG. 4.

The performance material used advantageously in the side panels of the present invention is a soft elasticized breathable mesh knit weave (in a so-called four-by-four stretch weave) containing 80% Nylon™ and 20% Spandex™. Pouch 18 may be of a material containing 82% polyester and 18% Spandex™. In one embodiment, the balance of brief 10 is of the same material, however in an alternative embodiment, the balance of brief 10 is made of a 92% cotton, 8% Spandex™ fabric. The material of the side panels and pouch provide the intended isolating function while improving comfort, airflow, and support for the scrotum. The mesh fabric is light and soft to reduce discomfort and improve feel for the scrotum and phallus while in contact with fabric and garment design in the sensitive groin area including the genitalia. Thus, in embodiments where pouch compartment 18 has at least two layers of material (an inner layer 18' and an outer layer 18"), seam 18*a* is formed along the medial plane B (orthogonal to plane A containing where seams 20 run along front walls 26) in the outer layer of material 18", and inner liner 18' is positioned behind outer layer 18" so as to be adjacent the genitalia. In a preferred embodiment, inner liner 18' does not have a seam in contact with phallus 16, and preferably not in contact with the head 16*a* of the phallus. Rather, the front of inner liner 18' is one continuous soft, light piece of the above mentioned elasticized mesh material extending continuously from and between its laterally opposite seams 26*a*. Thus the apex point, generally indicated at 18*b*, of the portion of the pear-shaped pouch 18 containing the head 16*a* of the penis, does not have vertical or other seam closely adjacent to irritate the head 16*a*. As seen in FIG. 9, inner liner 18' has at its rearmost end, that is, adjacent perineum 24, a pair of divergent tails which when joined along seam 18*b*' form a shelf-like tableau or plateau 18*a*' cradling the underside of scrotum 14. Forward of tableau 18*a*' inner liner 18' is seamless so as to not irritate head 16*a* of phallus 16 when resting naturally at apex point 18*b*. Thus it will be seen also that one advantage of using a boxer-style brief is that the boxer-style provides improved room in the front for forming the pouch compartment, as compared to more constrictive styles of brief which pull relatively tightly in over the genitals.

Pouch compartment 18 and side panels 12 together more closely resemble the natural setting of the genitalia and contours for isolation of the scrotum and support. The pouch offers the following design features:

a) pouch 18 is shaped to provide maximum volume and support for genitalia, while promoting the natural positioning of genitalia, for improved air circulation and temperature control;

b) pouch 18 is anatomically shaped to allow scrotum 14 and phallus 16 to rest naturally; and c) pouch 18 utilizes elasticized mesh fabric to wick away moisture.

Viewed from the exterior of the pouch from compartment 18 appears bordered laterally by a pair of opposed facing curved (for example convex shaped) seams 26*a* bordered at the upper end 18*c* by waistband 22 and at the lower, rearmost end 18*d* by perineum area 24 adjacent the posterior perineum. The pouch exterior center seam 18*a* tracks from the waistband to the posterior perineum along the vertical plane B bisecting pouch compartment 18 and intersecting apex 18*b* of volume at the front point, specifically at an angle and location where the head 16*a* of the phallus 16 would most naturally rest. The sides of the exterior of pouch compartment 18 are defined by parallel seams 26*a* which track from the waistband 22 to the perineum area 24.

The pear-shape of pouch compartment 18, as viewed from the front and defined by seams 26*a*, which start at the waistband 22 and end near to the posterior perineum, create greater rear pouch volume in pouch compartment 18, increasing the depth and resulting in more area for the scrotum to hang naturally, while providing the cradle-like support on the shelf-like tableau 18' formed by the closing of seam 18*b'* of inner liner 18'. The width from the lateral exterior seams 26*a* to the center seam 18*a* optimizes a maximal volume while maintaining support. The apex 18*b* is situated to most fully accommodate the head 16*a* of the phallus 16.

The side panels 12 and the interior and exterior layers 18' and 18" respectively of pouch compartment 18 advantageously may share the interior seams 20 which create the pouch shape that is, seams 20 and 26*a* are coincident. The cooperation of the side-panels and pouch shape and construction serves to:

a) further enhance the cradle-like support of the garment through the opposed facing convex shape seam orientation of seams 26*a;* b) contain the genitalia while inhibiting contact between the fabric and the skin;

c) further accentuate the volume and freedom of movement within pouch compartment 18 while inhibiting the genitalia from escaping pouch compartment 18.

Figure 10:
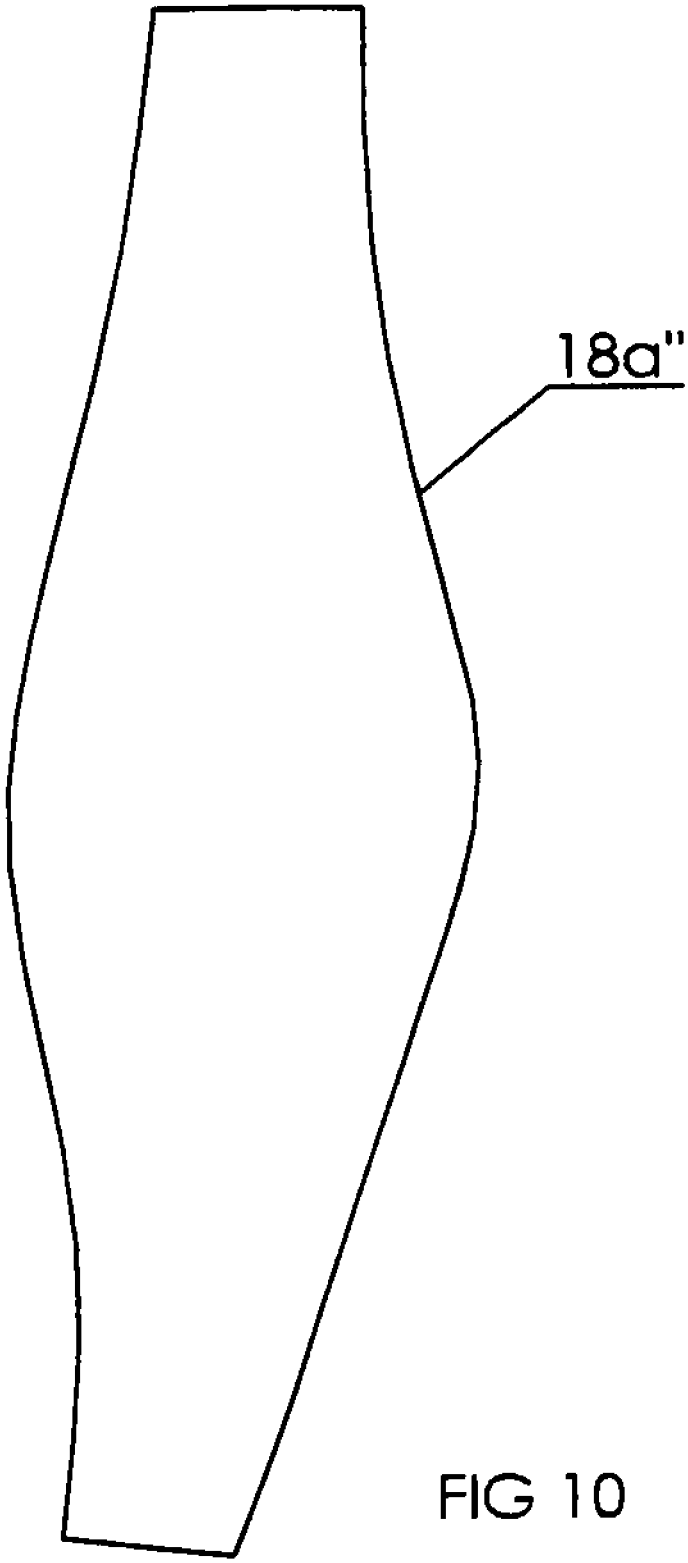
FIG. 10 is a diagrammatic view of a pattern template of a left front segment of an external layer of the pouch of FIG. 4.
Figure 11:
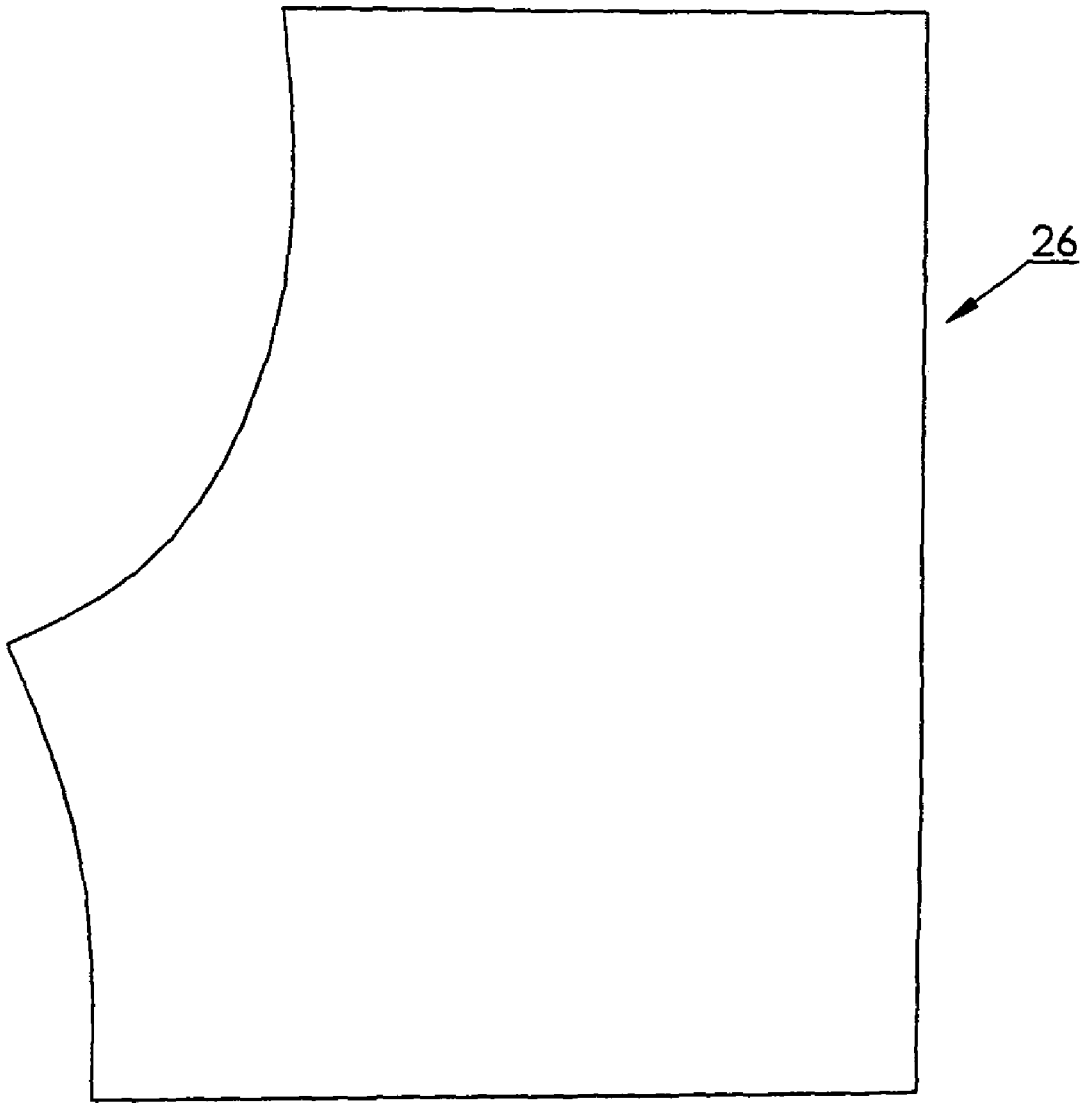
FIG. 11 is a diagrammatic view of a pattern template of a front panel of the briefs of FIG. 4.
Figure 12:
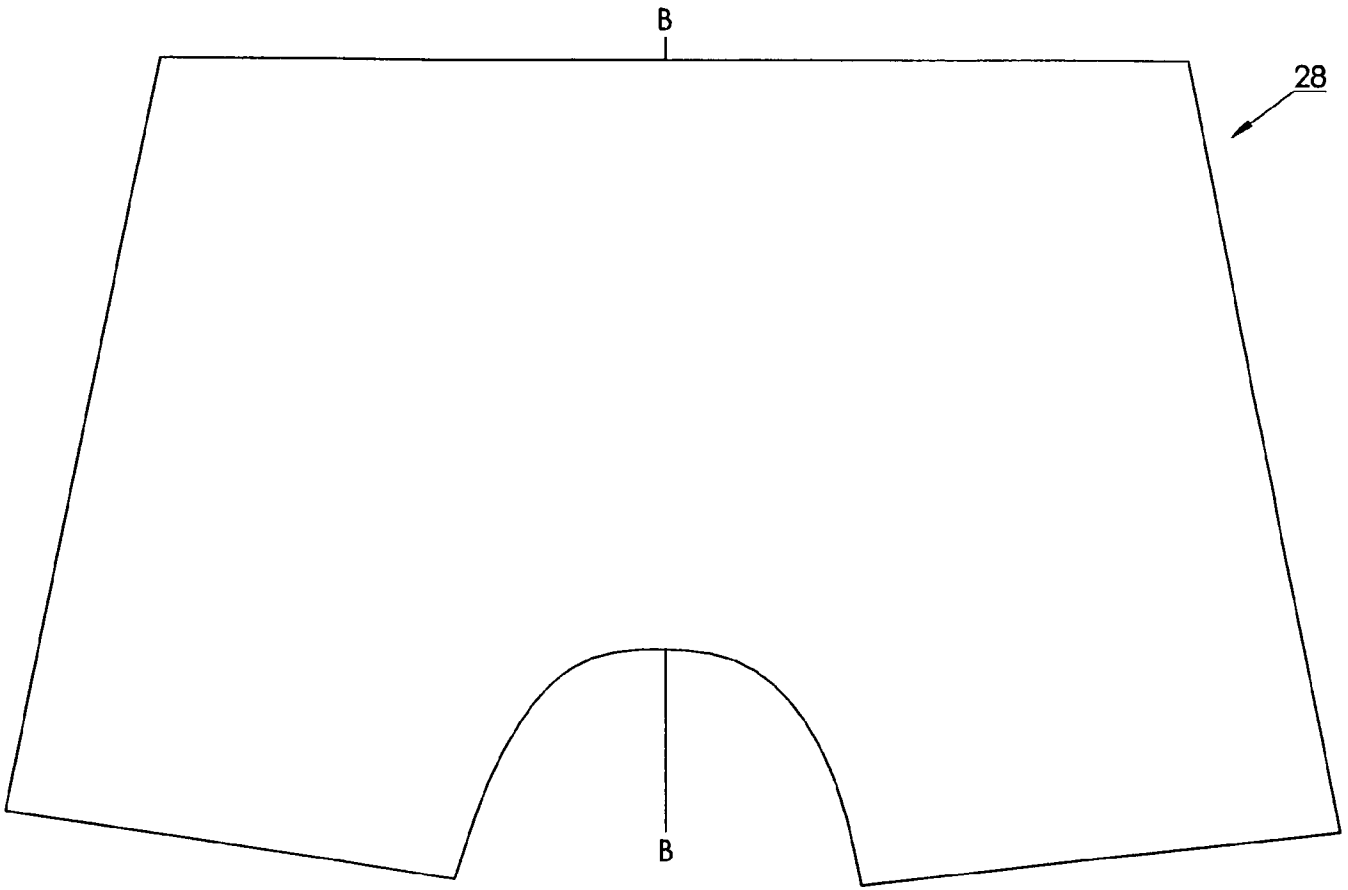
FIG. 12 is a diagrammatic view of a pattern template of a rear panel of the briefs of FIG. 4.
Figure 13:
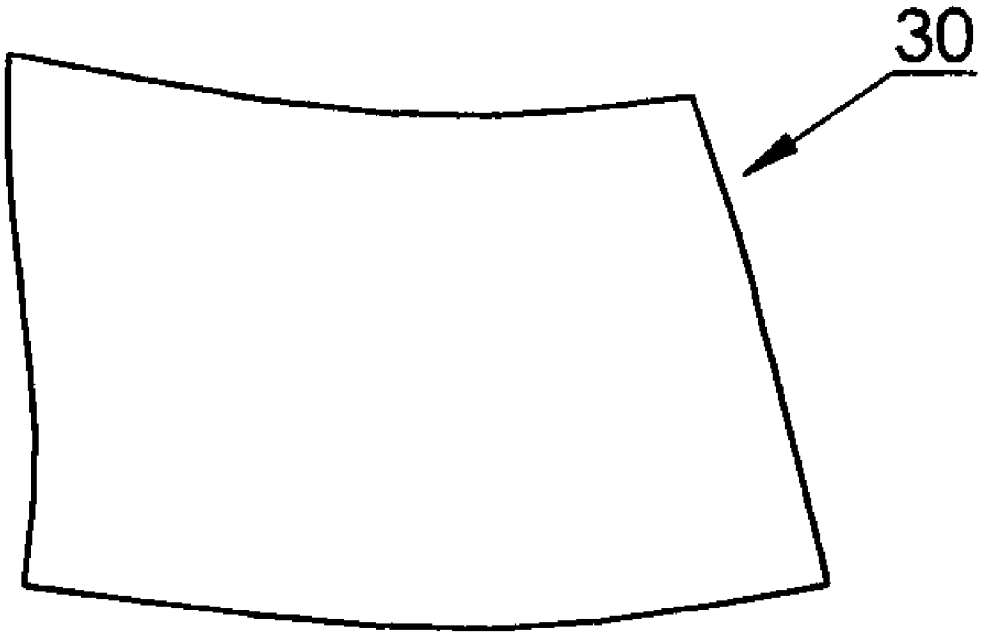
FIG. 13 is a diagrammatic view of a pattern template of a gusset of the briefs of FIG. 4.
Figure 14:
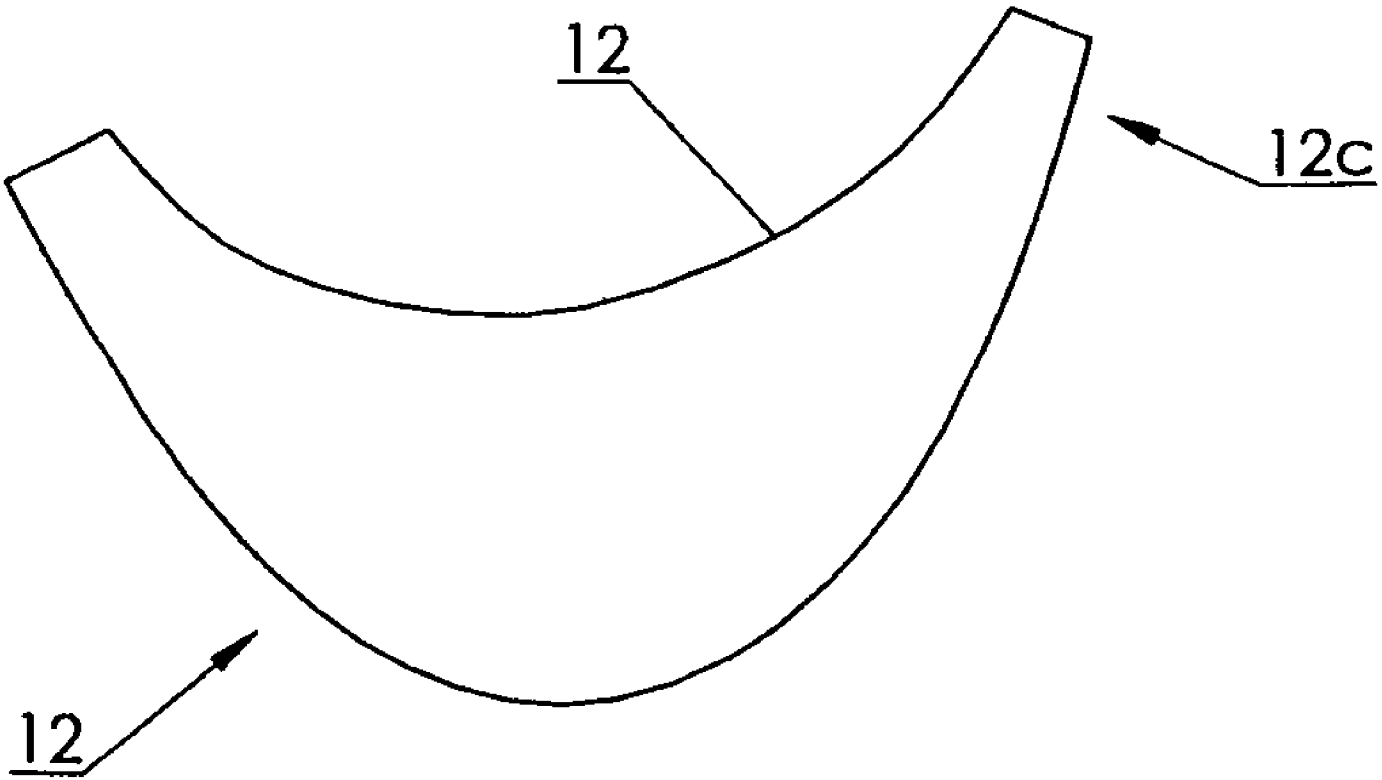
FIG. 14 is a diagrammatic view of a pattern template of one of the side panels of the briefs of the present invention.

As seen in the diagrammatic representations of fabric pattern templates used in the construction of brief 10 and as seen in FIGS. 9-14, as described above, inner liner 18' lies between front panels 26 and is bisected by plane B. Inner liner 18' is encased in left and right front segments 18*a"* of which FIG. 10 is an illustration of a left front segment when viewed from the front of briefs 10, the right front segment 18*a"* being the mirror image thereof. An illustration of an example of a right front panel 26 is seen in FIG. 11. An illustration of a rear panel 28 is seen in FIG. 12. Front panels 26 are joined to rear panel 28 along seams 26*b*. An illustration of one of the pair of left and right gussets 30 is seen in FIG. 13, the opposite gusset 30 being the mirror image thereof . Gussets 30 extend laterally from the rearmost end of pouch compartment 18, where they share a common seam 30*a* and extend laterally down the oppositely disposed legs 32 so as to terminate at legbands 32*a*, it being understood that the length of gussets 30 will of course depend on the length of legs 32. An example of the side panel 12 is illustrated in FIG. 14.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. For wearing by a user having a penis, a scrotum, and a perineum an underwear garment comprising:

a waistband, and a front wall depending downwardly from the front thereof, a genital pouch formed in a mid-section of said front wall so as to bisect said front wall, said pouch pear-shaped when viewed from the front and having a lower extremity thereof which extends under and rearwardly of said front wall so as to form a perineum portion for covering past the scrotum and to the perineum of the user when worn by the user, said pouch having a phallus supporting portion extending forwardly of a plane generally containing said front wall and forming therein an apex portion for containing a head of the penis of the user when the penis is hanging at rest, said pouch having a scrotum supporting portion extending from and between said phallus supporting portion and said perineum portion for containing at least a portion of the scrotum of the user, a pair of laterally spaced apart, separate and substantially parallel side panels forming upwardly from adjacent the perineum generally vertical extending scrotum fences towards said waistband, spaced so as to snugly engage sides of the scrotum and to substantially completely cover over and support the sides of the scrotum and to extend upwardly into a fold along a lowermost aspect of the abdomen of the user formed between the scrotum and the inner thighs of the user so as to substantially entirely cover exposed thigh skin in the fold exposed for rubbing against scrotum skin in the fold.

2. The garment of claim 1 wherein said side panels are formed as opposed facing concavities so as to cup the scrotum.

3. The garment claim 2 wherein said side panels are formed of wicking mesh.

4. The garment of claim 3 wherein said mesh is elasticized.

5. The garment of claim 4 wherein said side panels are scimitar-shaped when viewed from the side so as to form with said pouch said scrotum supporting portion as a crescent half-moon-shaped basket.

6. The garment of claim 5 wherein said pouch is formed of elasticized mesh.

7. The garment of claim 6 wherein said pouch has an inner lining which is smooth and seamless over a central penis-covering portion thereof.

8. The garment of claim 2 wherein said concavities are formed at least in part by being folded laterally inwardly and uppermost ends of said side panels being stitched so as to fold over an uppermost edge of said side panels.

9. The garment of claim 2 wherein said side panels extend substantially up to said waistband.

10. The garment of claim 9 wherein said pouch extends between said side panels substantially up to said waistband.

11. The garment of claim 1 wherein said side panels extend upwards so as to contact said waistband.

* * * * *